US007802984B2

(12) United States Patent
Specht

(10) Patent No.: US 7,802,984 B2
(45) Date of Patent: Sep. 28, 2010

(54) SYSTEM AND METHOD FOR COMBUSTION-AIR MODULATION OF A GAS-FIRED HEATING SYSTEM

(75) Inventor: Werner Specht, Hermitage, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 1209 days.

(21) Appl. No.: 11/400,681

(22) Filed: Apr. 7, 2006

(65) Prior Publication Data

US 2007/0238057 A1 Oct. 11, 2007

(51) Int. Cl.
*F23N 1/02* (2006.01)

(52) U.S. Cl. ..... 431/89; 431/12; 431/38; 431/37; 431/36

(58) Field of Classification Search ..... 431/89, 431/36, 37, 38, 12; 236/15 BD, 15 C
See application file for complete search history.

(56) References Cited

U.S. PATENT DOCUMENTS

| | | | | |
|---|---|---|---|---|
| 4,340,355 | A | 7/1982 | Nelson et al. | |
| 5,798,596 | A * | 8/1998 | Lordo | 310/216.016 |
| 6,295,937 | B1 | 10/2001 | Nakanishi et al. | |
| 6,866,202 | B2 | 3/2005 | Sigafus et al. | |
| 2005/0229711 | A1 | 10/2005 | Ohms et al. | |

FOREIGN PATENT DOCUMENTS

| | | |
|---|---|---|
| AT | 398622 | 1/1995 |
| DE | 19711081 | 10/1998 |
| DE | 19961285 | 6/2001 |
| EP | 0626541 | 11/1994 |
| EP | 0863367 | 9/1998 |
| EP | 1571394 | 9/2005 |
| JP | 59167633 | 9/1984 |
| JP | 62102026 | 5/1987 |
| JP | 03291411 | 12/1991 |
| JP | 06050533 | 2/1994 |
| JP | 2003-074839 | 12/2003 |
| WO | WO 0233499 | 4/2002 |
| WO | WO 03098123 | 11/2003 |

OTHER PUBLICATIONS

European Search Report issued on Dec. 18, 2009 from related European Patent Application No. 07251510.
Canadian Office Action dated Dec. 29, 2009 from related Canadian Patent Application No. 2,582,197.

* cited by examiner

*Primary Examiner*—Alfred Basichas
(74) *Attorney, Agent, or Firm*—Hoffmann & Baron, LLP

(57) ABSTRACT

A system and method for providing a gas-fired heating system with improved thermal efficiency includes modulating a quantity of combustion air flow to a combustion mixture in response to a measured change in fuel-gas pressure using a DC (e.g., brushless) motor to drive a combustion air blower. A pressure transducer in a manifold transporting fuel-gas into the combustion mixture outputs a signal proportional to the measured pressure to the motor. The motor speed and thus the resultant quantity of combustion air flow are modulated in proportion to the quantity of fuel-gas to the mixture. Accordingly, a constant fuel-gas to combustion air ratio is maintained. The system and method may further provide for adjusting the output signal to accommodate measured intake air temperature, and/or measured atmospheric pressure in order to maintain a constant, good thermal efficiency (preferably ≧80%) regardless of air temperature and altitude at the system's installation location.

10 Claims, 3 Drawing Sheets

SYSTEM AND METHOD FOR COMBUSTION-AIR MODULATION OF A GAS-FIRED HEATING SYSTEM

BACKGROUND OF THE INVENTION

The present invention relates generally to improving the thermal efficiency of heaters or furnaces and, more particularly, to modulating or controlling combustion air flow in relation to the fuel-gas flow in a gas-fired combustion system.

Gas-fired heating systems such as furnace or make-up air systems, or space heaters, typically take in outside air, heat it to a temperature set by a thermostat, and discharge the heated air inside the building. Contemporary heating systems, for example, furnaces for space heating or make-up air heating, are generally equipped with fuel valves which can be used to modulate the fuel-input rate to the heater in order to maintain a stable and controlled temperature. This type of system generally has a limited range of fuel-input modulation. In addition, these contemporary heaters suffer from a loss of thermal efficiency as the fuel-input rate is reduced below their full fuel-input rate.

Alternatively, such controlled temperature systems may also include some type of damper to open or close a combustion air by-pass. As a result of the ability to vary the amount of combustion air accessible to the system, these systems offer a broader possible range of fuel input modulation. Typically, however, the damper has only a few static positions available, which limits the actual control over the ratio of fuel to air.

Other known heating systems provide improved thermal efficiency by controlling the supply of fuel and combustion air in predetermined incremented amounts. However, these systems are complex and costly, requiring accurate sensor systems, flow control devices such as mechanical jackshafts, and the application of algorithms and control units to regulate the thermal efficiency.

Conventional modulating gas-fired burners modulate the fuel-gas flow in response to the flow rate of combustion air. Such systems are conventionally used in conjunction with power burners, which utilize so-called "drum and tube" type heat exchangers as known to those skilled in the art, and are not very amenable for use with tubular, clamshell, serpentine or other heat exchangers. In addition, the modulation of the fuel-gas flow in these conventional systems requires some type of sensor to monitor the combustion air flow rate and a valve to adjust the gas flow accordingly. In particular, a special gas valve is commonly used that responds to varying low negative pressures as measured by a pressure sensor. However, the accuracy of measuring these low negative pressures is limited and adversely affects the ability to accurately control the fuel-gas flow rate. Subsequently, the accuracy to which the air to fuel gas ratio and, subsequently, the thermal efficiency is limited in conventional modulating heating systems.

There is a need, therefore, for an efficient system and method for modulating or controlling the relative combustion air flow and fuel-gas flow of a gas-fired heating system.

SUMMARY OF THE INVENTION

The present invention, which addresses the needs of the prior art, relates to a system and method for modulating or controlling the combustion air flow in proportion to the fuel-gas flow in a gas-fired heating system. In particular, the system and method of the present invention modulates combustion-air supply in direct proportion to the quantity of gas being burned by monitoring fuel-gas pressure present at the heater's burner.

In particular, the present invention relates to a method for improving the thermal efficiency of a gas-fired heating system. The method includes modulating a quantity of combustion air flow to a combustion mixture in a gas-fired heating system in response to a measured change in fuel-gas pressure in an input manifold. The input manifold transports fuel-gas to the combustion mixture, therefore, by an amount required to maintain a constant fuel-gas to combustion air ratio in the combustion mixture.

In one aspect, the modulating step includes continuously measuring the fuel-gas pressure in the input manifold; and generating an electrical signal that is proportional to the measured fuel-gas pressure. The electrical signal increases in response to an increase in the measured fuel-gas pressure. The modulating step further includes increasing a speed of a combustion air blower in response to an increase in the electrical signal, thereby proportionately increasing the combustion air and fuel-gas in the combustion mixture.

In another aspect, the modulating step further includes inputting the electrical signal to a motor for controlling the speed of the combustion air blower, wherein the speed varies linearly with the electrical signal.

In yet another aspect, the method of the present invention further includes varying a quantity of fuel-gas flow in response to a measured temperature differing from a temperature set point on a temperature regulator. The varying step includes at least partially closing a valve in the input manifold in response to the measured temperature increasing above the temperature set point, and at least partially opening the valve in response to the measured temperature decreasing below the temperature set point. The temperature set point may be manually adjusted above or below the measured temperature.

In still another aspect, the method further includes generating the combustion air flow by pulling in outside air and measuring the intake air temperature. The method further includes readjusting the modulated quantity of combustion air flow to compensate for effects of the intake air temperature on maintaining the constant fuel-gas to combustion air ratio in the modulating step.

In an additional aspect, the method further includes measuring the atmospheric pressure at an installation location of the gas-fired heating system. The and modulated quantity of combustion air flow is readjusted to compensate for effects of the atmospheric pressure on maintaining the constant fuel-gas to combustion air ratio in the modulating step.

The present invention also relates to a system for improving the thermal efficiency of a gas-fired heating system. The system includes a burner for receiving a combustion mixture; an input manifold for transporting a fuel-gas to the combustion mixture; a pressure transducer for measuring the fuel-gas pressure in the input manifold; and a combustion blower for providing combustion air flow to the combustion mixture. The system further includes a direct current motor operatively connected to the combustion blower and pressure transducer. The motor drives the combustion blower at a speed proportional to the measured fuel-gas pressure in the input manifold. As a result, a constant fuel-gas to combustion air ratio is maintained in the combustion mixture.

Preferably, the DC motor is a brushless DC motor.

Preferably, the constant fuel-gas to combustion air ratio provides a thermal efficiency of at least 80%.

In one aspect, the system further includes a motor control module operatively connected between the pressure transducer and the direct current motor. The motor control module outputs an electrical signal to the direct current motor in response to an input signal from the pressure transducer which is proportional to the measured fuel-gas pressure.

The motor control module may include a temperature control module and the system further include a temperature sensing device for sensing the temperature of the intake air to the combustion air blower. The output electrical signal is adjusted by the temperature control module in accordance with the sensed intake air temperature to maintain the constant fuel-gas to combustion air ratio in said combustion mixture.

In another aspect, the motor control module may additionally or optionally include an atmospheric compensation module, and the system may further include a barometer for sensing atmospheric pressure. The output electrical signal is adjusted by the atmospheric compensation module in accordance with the sensed atmospheric pressure to maintain the constant fuel-gas to combustion air ratio in the combustion mixture.

In yet another aspect, the system further includes a fuel-gas valve upstream of the pressure transducer and a temperature regulator with an adjustable temperature set point. The fuel-gas valve is configured to vary a quantity of fuel-gas transported to the combustion mixture such that a difference between a sensed temperature and the temperature set point is minimized.

As a result, the present invention provides a method and system for modulating combustion air flow in a gas-fired heating system in proportion to the quantity of gas being burned by monitoring the fuel-gas pressure at the burner of the heating system. As a result, the thermal efficiency and combustion quality of the heating system may be improved.

DETAILED DESCRIPTION OF THE INVENTION

The present invention provides a method and system for modulating the combustion-air supply in a gas-fired heating system in order to provide improved thermal efficiency. Such heating systems may include, for example, furnace or make-up air systems, or space heaters.

Conventional modulating gas-fired burners exhibit improved thermal efficiency, combustion quality, and ignition reliability, by modulating the fuel-gas flow in response to the flow rate of combustion air. However, the ability to accurately control the fuel-gas flow is negatively affected by the low negative pressures of the combustion air flow measurements. As a result, it is often difficult to maintain good thermal efficiency over a broad modulation range in conventional modulating gas fired burners.

Figure 1:
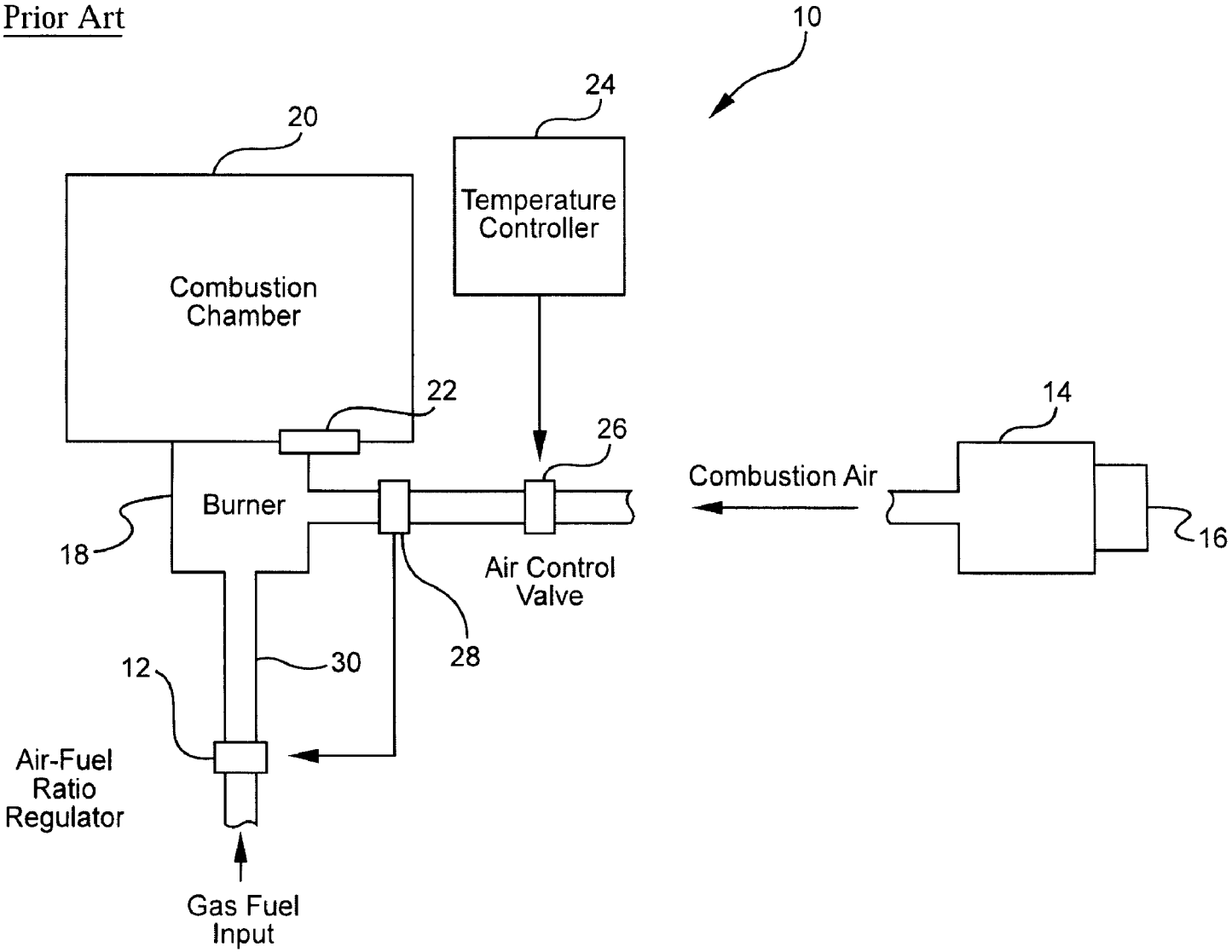
FIG. 1 Prior Art
FIG. 1 is a block diagram describing basic components of a prior art variable fuel-input rate heating system.

Referring to FIG. 1, a typical prior art variable fuel-input rate system 10 includes a valve or regulator 12 for varying the fuel-input rate, a combustion air blower 14 or other means for providing combustion air, an alternating current (AC) electric motor 16 for operating the blower 14, and a power burner 18. The burner 18 receives the fuel and combustion air mixture and conveys the mixture to a combustion chamber 20 where it is ignited by an ignition gun 22 during the combustion process.

The system 10 further includes a temperature control unit 24 with a variable input temperature set point and an air control valve 26. As the temperature set point increases, the temperature control unit 24 signals the air control valve 26 to open in response, or the blower 14 to increase or decrease air flow. A pressure sensor 28 downstream of the air control valve 26 outputs a pressure signal to the regulator 12 which is proportional to the increased air flow to the burner 18. In response, the regulator 12 opens a valve in the fuel line 30 in an attempt to maintain an ideal fuel gas-air ratio. Such gas-air ratio regulators, which are well-known to those skilled in the art, function to increase fuel flow as a function of air impulse pressure in order to maintain a particular air-gas ratio. The degree of linearity that can be achieved is dependent, therefore, on the characteristics of the particular regulator. The turndown ratio, or maximum to minimum fuel-input rates, possible with such systems is typically in the range of about 7 to 1.

In contrast to conventional methods, the method of the present invention provides improved thermal efficiency across the operating range of a gas-fired heating system by modulating a quantity of combustion air flow into a combustion mixture in response to a measured change in fuel-gas pressure in the manifold. In this way, a constant or substantially constant fuel-gas to air ratio is maintained in the mixture without having to rely on the low negative pressure measurements of combustion air flow.

Figure 2:
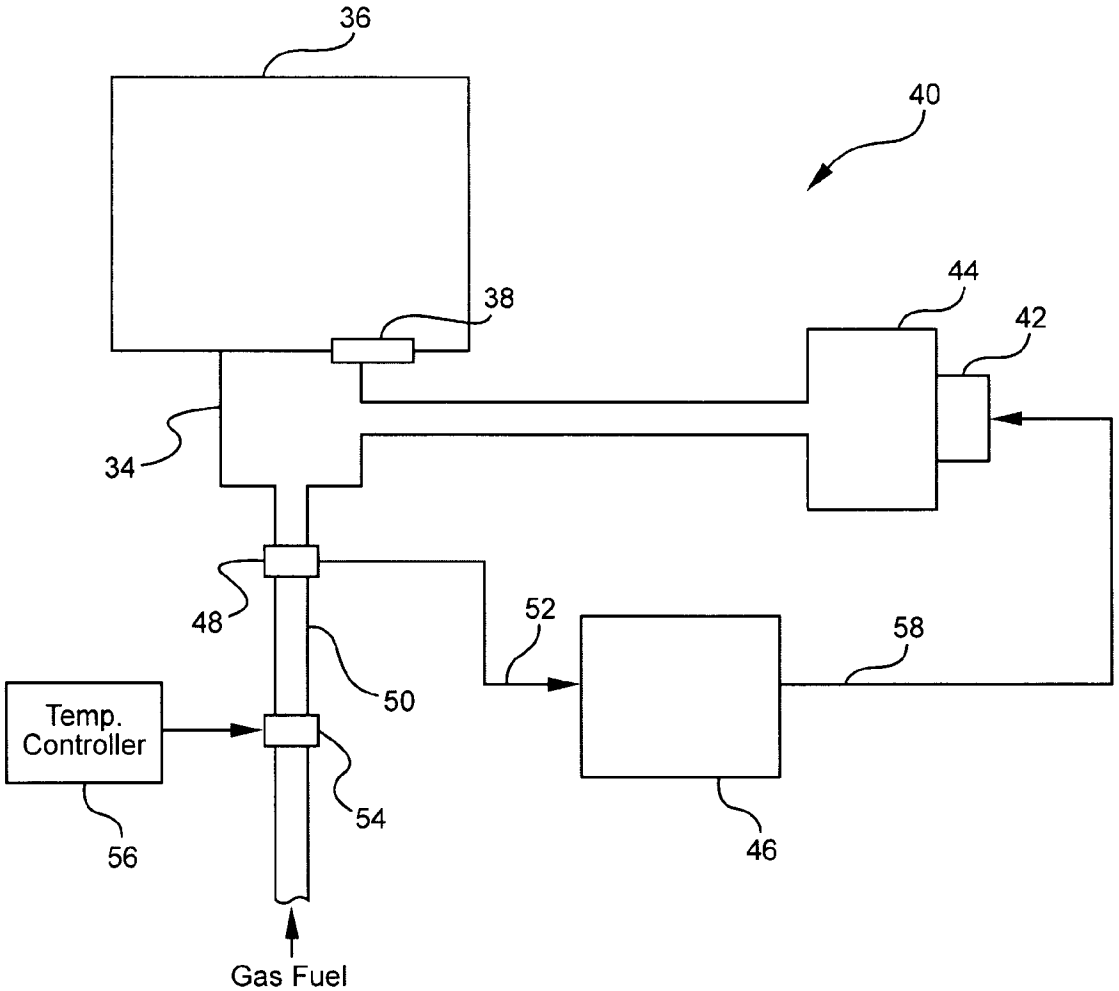
FIG. 2 is a block diagram of an embodiment of a modulated gas-fired heating system formed in accordance with the present invention.

A system 40 for implementing the method of controlling the fuel-gas to air ratio of a gas-fired heating system, such as a space heater or make-up air heater, in accordance with the present invention is shown in FIG. 2. The system 40 preferably includes a burner 34 for receiving fuel-gas and combustion air, a combustion chamber 36 into which the fuel-air mixture is transferred, and an ignition gun 38 which ignites the mixture during the combustion process.

The system 40 includes a direct current (DC) motor 42, a combustion air blower 44, a motor control module 46, and a fuel-gas pressure transducer 48. The DC motor 42 drives the combustion air blower/exhauster 44. In turn, the combustion air blower 44 supplies combustion air to the burner 34 at a rate determined by the operating speed of the DC motor 42. The operating speed is controlled by a signal output from the motor control module 46. The motor control module 46 includes logic circuitry configured to modulate the speed of the DC motor 42 in order to maintain an appropriate quantity of combustion air in the burner for maintaining good thermal efficiency at a substantially constant level.

The combustion air blower/exhauster 44, burner 34 and ignition gun 38 may be any such devices known to those skilled in the art for use in gas-fired heating systems.

The DC motor 42 may be any DC motor capable of responding to a change in input voltage with a proportional change in motor speed, i.e., in the speed of the combustion blower. In a preferred embodiment, the DC motor 42 is a brushless DC motor.

One skilled in the art will recognize that the required speed and power of the DC motor will be specific to the type of combustion blower used and the input capacity of the gas-fired heater. As one example for use with a particular gas-fired heating system, the DC motor may be a brushless DC continuous duty motor requiring a 24 VDC source voltage, and which can be linearly adjusted using a range of input voltages of either 0 to 5 VDC or 0 to 10 VDC to control the speed of the motor in a range of at least 1400 to 4000 rpm. In addition, the motor preferably has a torque rating of at least 0.265 N-m at 3400 rpm and a minimum efficiency of 75% at full load.

The pressure transducer 48 is positioned and configured to provide a measurement of the fuel-gas pressure in the input manifold 50, preferably positioned proximate the burner 34, and to output a signal 52 which is proportional to the measured fuel-gas pressure in the line 50. The transducer output signal 52, which is preferably linearly dependent on the measured fuel-gas pressure, is operatively connected to the motor control module 46. Therefore, because of the linear relationship between the input voltage to the DC motor 42 and the speed of the motor 42, the motor speed is also linearly dependent on the measured fuel-gas pressure.

The system 40 preferably also includes a fuel-gas valve 54 upstream of the pressure transducer 48 for controlling the quantity of fuel-gas entering the burner 34 and a temperature regulator 56 operatively connected to the fuel-gas valve 54. The temperature regulator 56 and fuel-gas valve 54 may include any such temperature regulating/modulating devices known to those skilled in the art for use with space or make-up air temperature controls. Typically, the temperature regulator 56 includes a thermistor with a user-variable temperature set point for providing a measurement of temperature. When the set point is increased, the fuel-gas valve 54 is at least partially opened in response, and when the measured air temperature reaches the set point, the fuel-gas valve 54 is at least partially closed, so that the difference between the sensed temperature and the temperature set point is minimized. Preferably, the difference is maintained at "zero." One skilled in the art will recognize that the accuracy to which the difference can be minimized to zero depends largely upon the manufacturing tolerances of the thermistor, gas valve, combustion air blower, and associated control electronics, for example.

When the fuel-gas valve 54 is opened, the pressure increases in the manifold 50. In accordance with the method of the present invention, in response to the increase in pressure as measured by the fuel-gas pressure transducer 48, the speed of the combustion air blower 44 increases in order to maintain an optimum ratio of air and fuel-gas in the mixture in the burner 34. Preferably, the air to fuel-gas ratio provides a substantially constant thermal efficiency. Most preferably, the thermal efficiency is maintained at or above 80% over the range of the modulated fuel-gas input.

The pressure transducer 48 of the present invention includes any pressure sensor, of any type, with a linear and preferably amplified output, and which is capable of measuring the relatively low pressure levels in the fuel-gas manifold 50. In addition, the pressure transducer 48 can preferably measure over a range of fuel-gas pressures that would allow for deep modulation (from 0 to 100%) of the fuel-gas flow in the manifold 50.

In one embodiment, the fuel-gas is natural gas and the operating pressure range of the transducer 48 is from 0 to 5 inches water column. In another embodiment, the fuel-gas is propane gas and the operating pressure range of the transducer 48 is from 0 to 10 inches water column. The accuracy of measurement of pressure in the manifold 50 provided by the pressure transducer 48 is preferably within ±1%.

In a preferred embodiment, the pressure transducer may include, for example, a silicon-based sensor, such as Part No. 5 INCH-G-4V-MINI or 10 INCH-G-4V-MINI from All Sensors Corp., 16035 Vineyard Blvd., Morgan Hill, Calif. 95037 for natural and propane gas respectively.

In other embodiments, the pressure sensor transducer may include, but is not limited to, a solid-state, e.g., a Hall effect sensor, a piezoelectric, or a Micro Electro Mechanical Systems (MEMS) silicon-based sensor.

The preferred optimum ratio of air to fuel-gas is that ratio required to maintain a thermal efficiency of at least 80%, regardless of the temperature or other characteristics of the intake air. One skilled in the art will appreciate that the particular fuel to combustion air ratio required to maintain this thermal efficiency may be determined through stoichiometry.

Preferably, the method of the present invention includes maintaining a substantially constant thermal efficiency in the modulating fuel-gas system 40, preferably at 80% or above. "Constant" and "substantially constant" as used herein in reference to fuel-gas to air ratio and thermal efficiency means a constant value to within the manufacturing tolerances of the devices providing the fuel-input and combustion air flow, including the linearity of the pressure transducer (typically 1 to 2%). For example, the speed of the motor may vary independently of the characteristics of the combustion air due to factors such as fluctuations in the power source, which can not be totally removed in the electrical design. Such fluctuations may result in fluctuations in the speed of the motor of from ±1-2 percent to ±5 percent, depending on the motor characteristics and operating parameters.

As known to those skilled in the art, a constant input voltage applied to a DC motor results in an acceleration of the speed of the motor until a constant operating voltage and speed is obtained. An increase or decrease in the input voltage results in a linear increase or decrease in the operating voltage and speed respectively, within a particular range of acceptable input voltages.

Motor controllers for operating and varying the speed of a brushless DC motor in response to a change in an input signal, e.g., a DC voltage, are known to those skilled in the art and typically include a rectifier and logic circuitry. The motor control module 46 of the present invention may include any known motor controller capable of modulating the speed of the motor 42 as required to maintain an optimum ratio of air to fuel-gas in the burner 34 over the entire range of gas pressures of the system 40 as measured by the pressure transducer 48. The input signal 52 to the motor control module 46 is preferably a DC voltage signal generated by the fuel-gas pressure transducer 48. Those skilled in the art will understand the requirements for optimizing a motor controller to adjust the speed of the motor from a minimum to maximum speed over a particular DC input voltage. The motor control module 46 of the present invention may be external or integral to the housing of the DC motor 42.

The combustion blower 44 may be used in particular make-up air heating systems that circulate outside air into the burner 34 and combustion chamber 36. The air entering the burner in this type of make-up air system can, therefore, vary substantially in temperature and will subsequently affect the efficiency of the combustion process.

Figure 3:
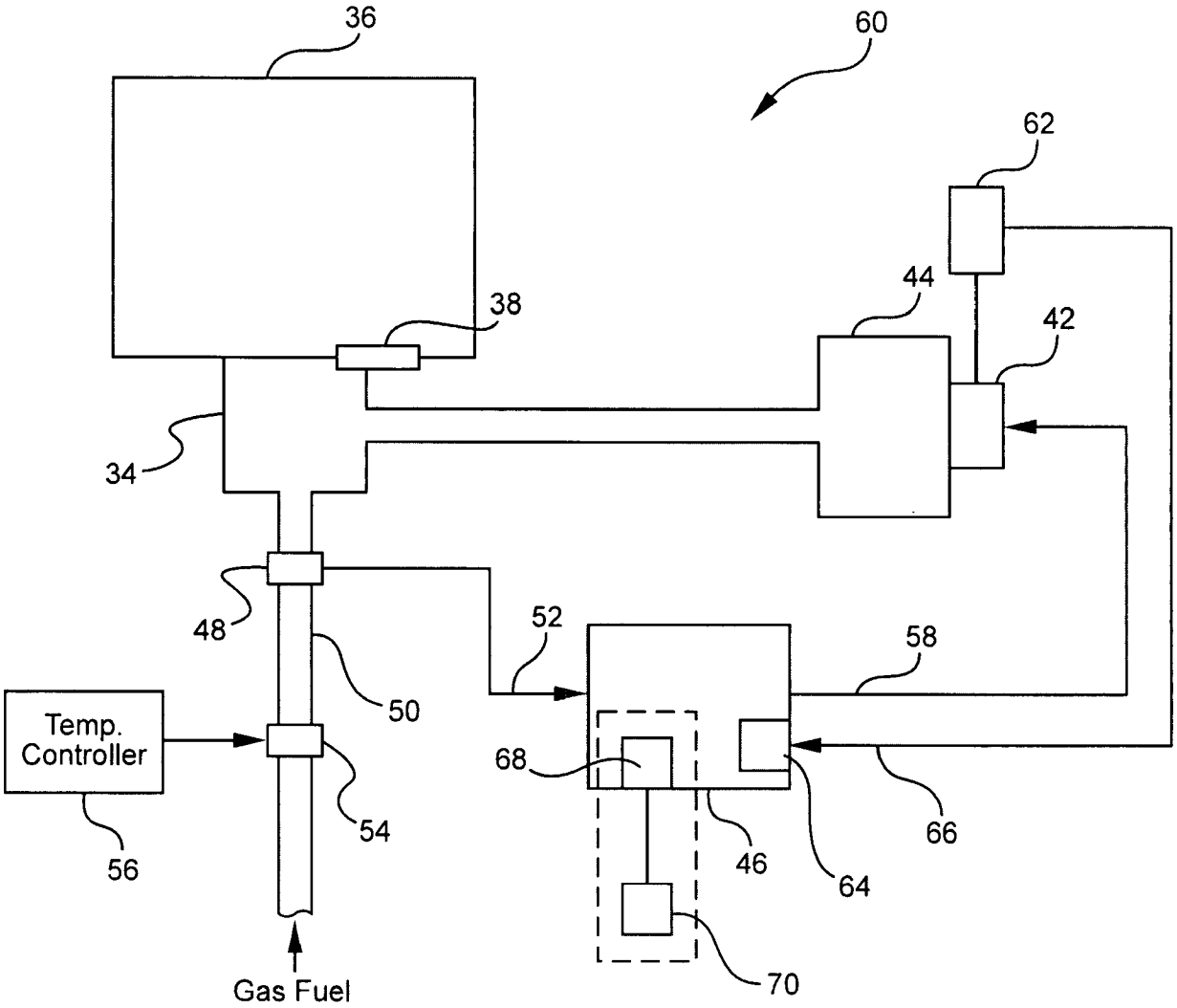
FIG. 3 is a block diagram of another embodiment of a modulated gas-fired heating system formed in accordance with the present invention.

Referring to FIG. 3, an additional embodiment 60 of the system of the present invention further includes a temperature sensing device 62, such as a thermistor, to sense the temperature of the combustion-air entering the combustion blower 44. In this embodiment, the motor control module 46 also includes a temperature control module 64 which additionally adjusts the output signal 58, and thus the motor speed of the DC motor 42, for optimum combustion of the fuel-gas in response to an increase or decrease in a signal 66 corresponding to the temperature of the air entering the blower 42. If unadjusted, particularly for temperatures lower than 32 degrees Fahrenheit, a significant loss of thermal efficiency results along with a potential deterioration of the quality of the products of the combustion process. Preferably, the temperature of the discharge air is maintained to within one or two degrees across a typical operating range of input temperatures.

In a further embodiment, the motor control module 46 also includes an atmospheric compensation module 68 operatively connected to a barometer 70 for measuring atmospheric pressure. The atmospheric compensation module 68 adjusts the speed range of the DC motor 42 to compensate for the altitude of the installation location. Therefore, full fuel-gas input operation is possible at all altitudes with the same unit. The atmospheric module 68 may be used to continuously monitor altitude, or may be connected one time, during installation, to a barometer and a constant altitude adjustment factor determined. Once the altitude adjustment factor is determined, connection to the barometer 70 is no longer required, unless the unit is moved at a later time and reinstalled elsewhere. Alternatively, the module 68 may be preset in the factory or store for a given altitude corresponding to the location where the heating system 60 with the atmospheric compensation module 68 is to be installed.

Conventional fuel-gas space heaters or make-up heaters must have their gas input decreased by as much as four percent for each 1000 feet of altitude above sea level. The atmospheric compensation module 68 provides cost advantages over a conventional system, in that the buyer of a heater in a high altitude location is typically required to select a larger heater to achieve the requisite heating capacity.

The method and system of the present invention for modulating the speed of the combustion air blower 44 may advantageously be used with any type of heat exchanger. In addition, the system can be used with conventional gas controls. Additional embodiments provide an optimum quantity of combustion-air regardless of the temperature of the incoming combustion-air, and/or regardless of the altitude at the installed location. The method and system of the present invention, therefore, advantageously provide control over the temperature of the discharged air, preferably to within one or two degrees, over a broad range of intake air temperatures and for different altitudes. In addition, the system is able to run steadily, without cycling on and off, and, therefore, efficiently, by allowing deep modulation of the fuel/air mix. As a result, the thermal efficiency and combustion quality of the heating system formed in accordance with the present invention are advantageously improved, providing lower turndown of the fuel-gas input rate and more reliable ignition of the combustion mixture.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A system for improving the thermal efficiency of a gas-fired heating system, the system comprising:

a burner for receiving a combustion mixture;

an input manifold for transporting a fuel-gas to said combustion mixture;

a pressure transducer for measuring the fuel-gas pressure in said input manifold;

a combustion blower for providing combustion air flow to said combustion mixture; and a direct current motor operatively connected to said combustion blower and said pressure transducer for driving said combustion blower at a speed proportional to the measured fuel-gas pressure in said input manifold thereby maintaining a constant fuel-gas to combustion air ratio in said combustion mixture.

2. The system of claim 1, further comprising a motor control module, wherein said motor control module is operatively connected between said pressure transducer and said direct current motor, and wherein said motor control module outputs an electrical signal to said direct current motor in response to an input signal from said pressure transducer which is proportional to the measured fuel-gas pressure.

3. The system of claim 2, wherein said motor control module comprises a temperature control module, the system further comprising a temperature sensing device for sensing the temperature of intake air into said combustion air blower, and wherein said output electrical signal is adjusted by said temperature control module in accordance with the sensed intake air temperature to maintain said constant fuel-gas to combustion air ratio in said combustion mixture.

4. The system of claim 2, wherein said motor control module comprises an atmospheric compensation module, the system further comprising a barometer for sensing atmospheric pressure, and wherein said output electrical signal is adjusted by said atmospheric compensation module in accordance with the sensed atmospheric pressure to maintain said constant fuel-gas to combustion air ratio in said combustion mixture.

5. The system of claim 1, wherein the direct current motor is a brushless direct current motor.

6. The system of claim 1, further comprising:

a fuel-gas valve upstream of the pressure transducer; and a temperature regulator comprising an adjustable temperature set point, wherein said fuel-gas valve is configured to vary a quantity of said fuel-gas transported to said combustion mixture such that a difference between a sensed temperature and said temperature set point is minimized.

7. The system of claim 1, wherein said constant fuel-gas to combustion air ratio provides a thermal efficiency of at least 80%.

8. The system of claim 1, wherein said pressure transducer comprises one or any combination of a solid-state sensor, a silicon-based sensor, a piezoelectric sensor, a Hall effect sensor, a micro electro mechanical systems sensor.

9. The system of claim 8, wherein said pressure transducer comprises a micro electro mechanical systems silicon-based sensor.

10. The system of claim 1, wherein said fuel-gas comprises one of a natural gas and a propane gas.

* * * * *